US010408543B2

(12) United States Patent
Barfknecht et al.

(10) Patent No.: US 10,408,543 B2
(45) Date of Patent: Sep. 10, 2019

(54) LIQUID TO REFRIGERANT HEAT EXCHANGER, AND METHOD OF OPERATING THE SAME

(71) Applicant: Modine Manufacturing Company, Racine, WI (US)

(72) Inventors: Robert Barfknecht, Waterford, WI (US); Jason Braun, Franksville, WI (US); Michael Eklund, Kenosha, WI (US); Thomas Grotophorst, Muskego, WI (US); Jeffrey Hanson, Racine, WI (US); Jean Lysoivanov, Mt Pleasant, WI (US); Kyle Shisler, Muskego, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 586 days.

(21) Appl. No.: 15/137,593

(22) Filed: Apr. 25, 2016

(65) Prior Publication Data

US 2016/0320141 A1 Nov. 3, 2016

Related U.S. Application Data

(60) Provisional application No. 62/155,809, filed on May 1, 2015.

(51) Int. Cl.
*F28D 9/00* (2006.01)
*F25B 39/04* (2006.01)
(Continued)

(52) U.S. Cl.
CPC ..... *F28D 9/0093* (2013.01); *F25B 39/04* (2013.01); *F28D 9/005* (2013.01); *F28F 9/026* (2013.01);
(Continued)

(58) Field of Classification Search
CPC ..... F28D 9/0093; F28D 9/005; F28D 2021/0084; F25B 39/04; F25B 40/02; F25B 2339/043; F25B 2339/0443; F28F 9/026
(Continued)

(56) References Cited

U.S. PATENT DOCUMENTS 5,628,206 A * 5/1997 Baba ..... B60H 1/3227 165/76
5,713,217 A * 2/1998 Baba ..... F25B 39/04 165/132
(Continued)

FOREIGN PATENT DOCUMENTS

WO WO-2014044520 A1 * 3/2014 ..... F25B 39/04

OTHER PUBLICATIONS

Chinese Patent Office Action for Application No. 201610268714.X dated Mar. 7, 2018 (20 pages, English translation included).
(Continued)

*Primary Examiner* — Raheena R Malik
(74) *Attorney, Agent, or Firm* — Michael Best & Friedrich LLP; Jeroen Valensa; Michael Bergnach

(57) ABSTRACT

A liquid to refrigerant heat exchanger is provided having a stack of nested plates with fluid flow passages defined between the plates. The stack includes a condenser portion and a subcooler portion. A base plate at a bottom end of the stack has a refrigerant outlet port and a receiver bottle joined to it. A receiver flow path extends through a structural connection joining the receiver bottle to the base plate to allow for fluid flow between an internal volume of the receiver bottle and the condenser portion. Another receiver flow path extends through another structural connection to allow for fluid flow between an internal volume of the receiver bottle and the subcooler portion.

20 Claims, 8 Drawing Sheets

(51) Int. Cl.
*F28F 9/02* (2006.01)
*F28D 21/00* (2006.01)
*F25B 40/02* (2006.01)

(52) U.S. Cl.
CPC ..... *F25B 40/02* (2013.01); *F25B 2339/043* (2013.01); *F25B 2339/0443* (2013.01); *F28D 2021/0084* (2013.01)

(58) Field of Classification Search
USPC ..... 165/166
See application file for complete search history.

(56) References Cited

U.S. PATENT DOCUMENTS 5,810,077 A 9/1998 Nakamura et al.
5,875,838 A 3/1999 Haselden
5,884,503 A * 3/1999 Inaba ..... F25B 39/04 62/509
6,032,728 A * 3/2000 Ross ..... F28D 1/05366 165/153
6,171,374 B1 * 1/2001 Barton ..... B01D 63/081 96/7
7,334,429 B2 * 2/2008 Forster ..... F25B 39/04 62/474
7,469,554 B2 12/2008 Martins et al.
8,122,736 B2 2/2012 Martins et al.
8,919,147 B2 * 12/2014 Wolk ..... F25B 39/04 62/509
10,060,658 B2 * 8/2018 Hofmann ..... F25B 39/04
2005/0230090 A1 10/2005 Higashiyama
2012/0137725 A1 6/2012 Kim et al.
2012/0234523 A1 * 9/2012 Jouanny ..... F28D 9/005 165/166
2012/0291478 A1 11/2012 Kim et al.
2013/0146257 A1 6/2013 Kim et al.
2013/0146265 A1 6/2013 Kim
2014/0102682 A1 4/2014 Kim et al.
2014/0110093 A1 4/2014 Kim et al.
2014/0224455 A1 8/2014 Kalbacher et al.
2015/0323231 A1 * 11/2015 Citti ..... F28D 9/005 62/516
2016/0161160 A1 6/2016 Hofmann et al.

OTHER PUBLICATIONS

Notification of Decision of Rejection for Chinese Patent Application No. 201610268714.X dated May 21, 2019, National Intellectual Property Administration of the People's Republic of China (12 pages).
Examination Report Under Sections 12 & 13 of the Patents Act, 1970 and the Patents Rules, 2003 for Indian Patent Application No. 201614013107 dated May 3, 2019, Intellectual Property India (8 pages).

* cited by examiner

LIQUID TO REFRIGERANT HEAT EXCHANGER, AND METHOD OF OPERATING THE SAME

CROSS-REFERENCE TO RELATED APPLICATIONS

This application claims priority to U.S. Provisional Patent Application No. 62/155,809, filed May 1, 2015, the entire contents of which are hereby incorporated by reference.

BACKGROUND

Liquid to refrigerant heat exchangers are known to be used to transfer thermal energy between a flow of refrigerant and a flow of liquid coolant. Such a heat exchanger can be used as a chiller heat exchanger, wherein heat from a flow of liquid coolant is transferred into a refrigerant to thereby vaporize the refrigerant, resulting in a chilled flow of liquid coolant exiting the heat exchanger. Alternatively, such heat exchangers can be used as a condenser, wherein heat from a flow of superheated refrigerant is transferred into a liquid coolant loop to thereby cool and condense the refrigerant.

Vehicular air conditioning and refrigeration systems have traditionally used air-cooled condensers to accomplish the cooling and condensing of the superheated refrigerant exiting the compressor of the refrigerant system. Such an air-cooled condenser is typically arranged at the front of the vehicle in order to receive the requisite flow of air, which can be provided by the propulsion of the vehicle itself, or by an air moving device, or both. Certain advantages may be obtained, however, by instead using a liquid cooled condenser to accomplish this task. By way of example, engine compartment packaging can be simplified by removing the condenser form the front end of the vehicle.

Challenges are also associated with the implementation of a liquid cooled refrigerant condenser in such an application, though. The temperature of the liquid coolant loop on a vehicle is necessarily higher than the ambient air temperature, so that head pressure of the refrigerant compressor will need to be increased in order to achieve the same amount of subcooling of the refrigerant as was previously achieved using an air-cooled condenser. Proper subcooling is important in reducing the overall energy consumption of such a system, as it increases the available specific enthalpy of the refrigerant flow in the evaporator of the system.

A further challenge is found in the implementation of an integrated receiver within the condenser of the system. A receiver is typically situated along the refrigerant flow path between a condenser section and a subcooler section of the condenser, and functions to ensure that only liquid refrigerant is provided to the expansion device that is typically arranged directly upstream of an evaporator of the system. Excess refrigerant is stored within the receiver in both a liquid and a vapor state, thereby preventing flooding of the condenser with excess liquid refrigerant, which could reduce operating efficiency. As shown and described in U.S. Pat. No. 5,934,102 to DeKuester et al., such a receiver is readily integrated into an air-cooled condenser as an additional cylindrical structure arranged adjacent to one of the cylindrical refrigerant headers.

Such an integration of the receiver is more difficult with a liquid cooled condenser constructed as a plate-style heat exchanger. Published U.S. patent application no. US2014/0224455 and published international patent application no. WO2014/085588 (both to the present applicant) show embodiments of a liquid to refrigerant heat exchanger with such an integrated receiver. In those applications, a separate refrigerant line extends from the condenser section of the heat exchanger to the receiver. This separate refrigerant line can add manufacturing cost and complexity. Thus, there is still room for improvement.

SUMMARY

According to an embodiment of the invention, a liquid to refrigerant heat exchanger includes a stack of nested plates with fluid flow passages defined between the plates. The stack of nested plates extends in a stacking direction between a top end and a bottom end of the stack, with a first subset of the stack adjacent to the top end defining a condenser portion, and a second subset of the stack adjacent the bottom end defining a subcooler portion. A cap plate is joined to the top end of the stack and has a refrigerant inlet port joined to it to receive a flow of refrigerant into the condenser portion. A base plate is joined to the bottom end of the stack and has a refrigerant outlet port joined to it on the side opposite the stack of nested plates. A receiver bottle is also joined to the base plate on the side opposite the stack. At least a first and a second structural connection join the receiver bottle to the base plate. A first receiver flow path extends through the first structural connection to allow for fluid flow between an internal volume of the receiver bottle and the condenser portion. A second receiver flow path extends through the second structural connection to allow for fluid flow between an internal volume of the receiver bottle and the subcooler portion.

In some embodiments the liquid to refrigerant heat exchanger includes a refrigerant manifold that extends through the subcooler portion and is hydraulically isolated therefrom. The refrigerant manifold provides a portion of the first receiver flow path.

In some embodiments, the heat exchanger includes a first, second, and third refrigerant manifold. The first refrigerant manifold is arranged at a first corner of the stack of nested plates, extends through only the condenser portion, and is fluidly coupled to the refrigerant inlet port to receive the flow of refrigerant. The second refrigerant manifold is arranged at a second corner of the stack, extends through only the condenser portion, and is connected to the first refrigerant manifold by some of the fluid flow passages defined between the plates of the condenser portion. The third refrigerant manifold extends through the subcooler portion and is hydraulically isolated therefrom, and provides a portion of the first receiver flow path.

In some such embodiments a first liquid manifold is arranged at a third corner of the stack, and a second liquid manifold is arranged at a fourth corner of the stack. The first and second liquid manifolds are connected by some of the fluid flow passages defined between plates in both the condenser portion and the subcooler portion. In some such embodiments the third refrigerant manifold is offset from the first, second, third, and fourth corners.

In some embodiments, a fluid transfer plate is provided in the space between a first one of the nested plates and a second adjacent one of the nested plates. The first one of the nested plates defines an end of the condenser portion and the second one of the nested plates defines an end of the subcooler portion. A fluid transfer conduit within the fluid transfer plate extends between the second and third refrigerant manifolds to provide a portion of the first receiver flow path.

In some such embodiments the heat exchanger further includes a fourth and a fifth refrigerant manifold. The fourth refrigerant manifold is arranged at the first corner of the stack of nested plates, extends through only the subcooler portion, and fluidly couples to the second receiver flow path to receive the flow of refrigerant. The fifth refrigerant manifold is arranged at the first corner of the stack of nested plates, extends through only the subcooler portion, and fluidly couples to the refrigerant outlet port to deliver the flow of refrigerant. The fourth and fifth refrigerant manifolds are connected by some of the fluid flow passages defined between plates in the subcooler portion. In some such embodiments the second and the fifth refrigerant manifolds are fluidly isolated from each other by the second one of the nested plates.

In some embodiments, the liquid to refrigerant heat exchanger includes a plurality of inserts arranged between at least some of the nested plates in the subcooler portion to at least partially define the third refrigerant manifold.

According to another embodiment of the invention, a method of operating a liquid to refrigerant heat exchanger to cool and condense a gaseous refrigerant includes receiving a flow of liquid coolant into the heat exchanger, directing a first portion of the flow through a condenser section of the heat exchanger, and directing a second portion of the flow through a subcooler section of the heat exchanger in parallel with the first portion. Gaseous refrigerant is received into the heat exchanger and is directed through the condenser section in order to cool and at least partially condense the gaseous refrigerant by transferring heat to the first portion of the flow of liquid coolant. The at least partially condensed refrigerant is routed to a receiver bottle integrated with the liquid to refrigerant heat exchanger by conveying the refrigerant through a flow conduit arranged at least partially within the subcooler section. The at least partially condensed refrigerant is separated into a liquid phase refrigerant portion and a gaseous phase refrigerant portion. The liquid phase refrigerant portion is directed through the subcooler section in order to further cool the liquid phase refrigerant by transferring heat to the second portion of the flow of liquid coolant. The liquid phase refrigerant is removed from the heat exchanger, and the first and second portions of the liquid coolant are recombined and removed from the heat exchanger.

In some embodiments, routing the at least partially condensed refrigerant to a receiver bottle includes first directing the refrigerant through a first portion of the flow conduit arranged between the condenser section and the subcooler section, and next directing the refrigerant through a second portion of the flow conduit. In some such embodiments the refrigerant is directed through a third portion of the flow conduit that extends through a structural connection of the receiver bottle after having been directed through the first and second portion of the flow conduit.

According to another embodiment of the invention, a liquid to refrigerant heat exchanger includes a stack of nested plates with fluid flow passages defined between the plates. Each of the plates has a generally rectangular shape, and each of the plates is provided with corner apertures at at least some of the corners. A first liquid manifold extending the height of the stack is defined by aligned corner apertures at a first corner of the plates, and is in fluid communication with a first liquid port arranged at a first end of the stack. A second liquid manifold extending the height of the stack is defined by aligned corner apertures at a second corner of the plates, and is in fluid communication with a second liquid port at the first end of the stack. A first refrigerant manifold extending over a first portion of the stack from the first end is defined by aligned corner apertures at a third corner of the stack, and is in fluid communication with a refrigerant inlet port at the first end of the stack. A second refrigerant manifold extending over the first portion of the stack from the first end is defined by aligned corner apertures at a fourth corner of the stack. A third refrigerant manifold extending over a second portion of the stack from a second end of the stack opposite the first end is defined by aligned corner apertures at the third corner. The second portion of the stack is not coextensive with the first portion of the stack. A fourth refrigerant manifold extends over the second portion of the stack from the second end, and is defined by aligned corner apertures at the fourth corner. A refrigerant outlet port is arranged at the second end of the stack, and is in fluid communication with the fourth refrigerant manifold. A fifth refrigerant manifold extends over the second portion of the stack, and is offset from each of the first, second, third, and fourth corners.

In some embodiments, the fluid flow passages defined between the plates include a first, a second, a third, and a fourth plurality of flow passages. The first plurality extends between the first and second refrigerant passages, and the second plurality extends between the third and fourth refrigerant manifolds. The third plurality is interleaved with the first plurality and extends between the first and second liquid manifolds, and the fourth plurality is interleaved with the second plurality and also extends between the first and second liquid manifolds. In some such embodiments the fifth refrigerant manifold extends through both the second and the fourth plurality of fluid flow passages, and remains fluidly isolated from those flow passages.

In some embodiments a fluid transfer plate is provided in the space between a first one of the nested plates and a second adjacent one of the nested plates. The first nested plate partially defines a fluid flow passage of either the first or the third plurality of fluid flow passages, and the second nested plate partially defines a fluid flow passage of either the second or the fourth plurality of fluid flow passages. A fluid transfer conduit within the fluid transfer plate provides fluid communication between the second and the fifth refrigerant manifolds. In some such embodiments the second one of the plates is devoid of a corner aperture at the fourth corner of the plate, and thereby isolates the second and the fourth refrigerant manifolds from each other.

DETAILED DESCRIPTION

Figure 1:
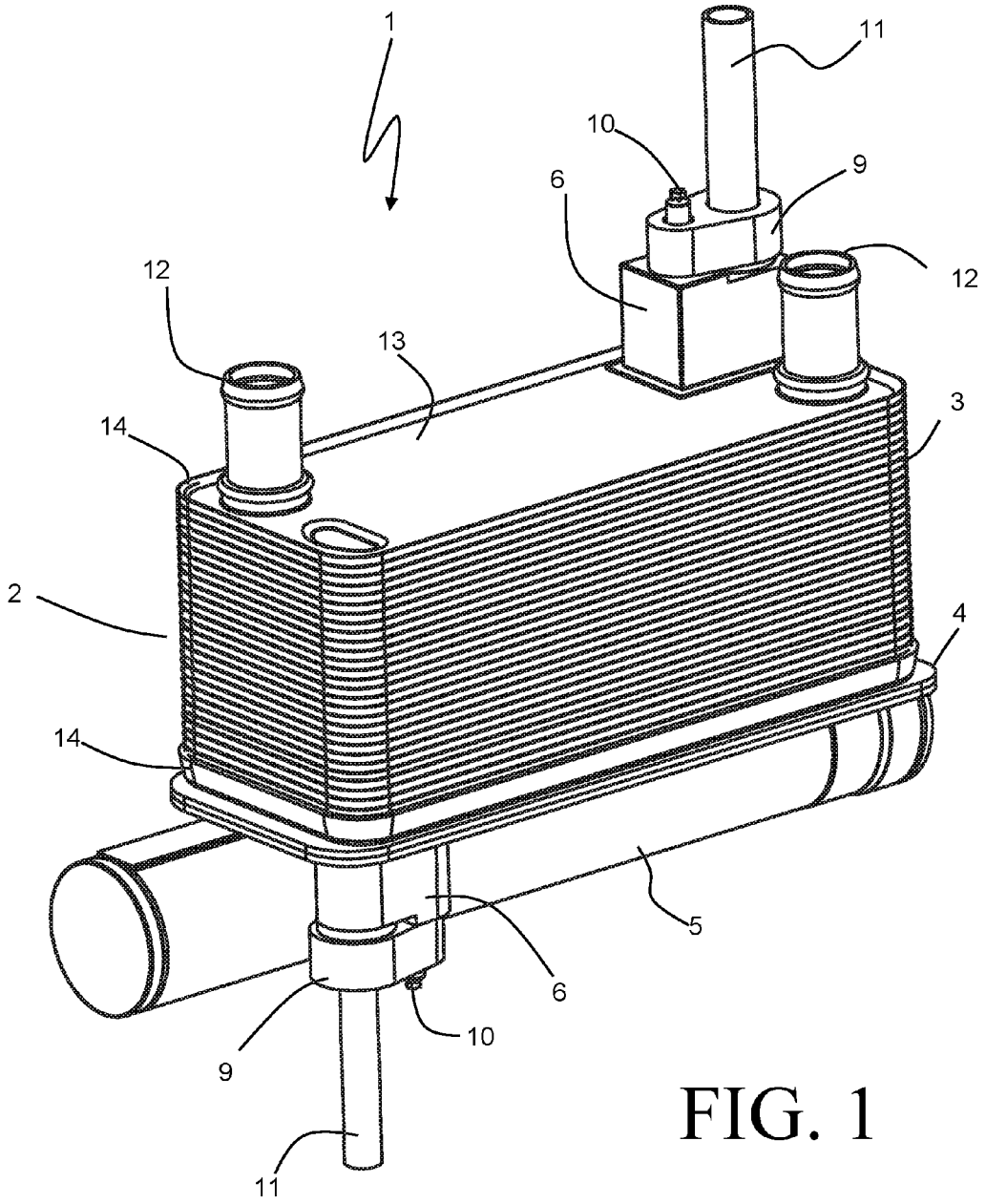
FIG. 1 is a perspective view of a liquid to refrigerant heat exchanger according to an embodiment of the invention.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

A liquid to refrigerant heat exchanger 1 according to some embodiments of the invention is shown in FIGS. 1-5. The heat exchanger 1 can be especially suitable for rejecting heat from a refrigerant stream in the high pressure portion of a vapor compression refrigerant circuit by condensing and subcooling the high pressure refrigerant between a compressor and an expander of such a system. The heat exchanger 1 can find particular utility in climate conditioning systems found in automobiles and other transportation vehicles by compactly and efficiently transferring the waste heat from the refrigerant to a liquid coolant loop traditionally found in such vehicles.

The heat exchanger 1 is constructed to include a stack 2 of nested plates or shells 3 formed from metallic sheet material (for example, aluminum). Such a construction can produce a compact and relatively light-weight heat exchanger, while still allowing for the required heat transfer efficiency and structural robustness necessary to withstand the extreme pressures that can be associated with the high pressure side of the refrigerant circuit.

The stack 2 of nested plates 3 is bounded by terminal plates 14 arranged at either end of the stack 2. The terminal plates 14 are generally of a similar construction to the other nested plates 3, with similar nesting features as will be described, but can be constructed with a greater material thickness in order to provide sufficient structural support and pressure capability. A cap plate 13 is joined to the top side terminal plate 14, and a base plate 4 is joined to the bottom side terminal plate 14. Note that, while reference is made herein to a "top side" and "bottom side" for ease of description, the heat exchanger 1 is not limited to an installation orientation wherein the stack 2 is arranged vertically with the so-called top side located above the so-called bottom side. The heat exchanger 1 can alternatively be operated in other orientations, such as with the plate stack 2 extending horizontally for example.

First and second liquid ports 12 are joined to the cap plate 13 at opposing corners of the stack 2, and provide an inlet and outlet for a flow of liquid coolant to be used as a heat transfer medium in the heat exchanger 1. Additionally, a refrigerant fitting 6 is joined to the cap plate 13 at a third corner of the stack 2. The cap plate 13 of the exemplary embodiment is a separate plate that is joined to the top side terminal plate 14, but in some embodiments the cap plate 13 may be integral to that terminal plate 14. In either case, apertures to receive (and/or fluidly communicate with) the liquid ports 12 and the refrigerant fitting 6 are provided in the cap plate 13.

The bottom side terminal plate is mounted and joined to the base plate 4, which is constructed as a flat plate having an outer periphery that is somewhat larger than the outer periphery of the terminal plate 14. In the exemplary embodiment, the base plate 4 is constructed of two joined plates 4*a* and 4*b*, although in other embodiments the base plate 4 could be constructed from a single plate.

A receiver bottle 5 is joined to the base plate 4 on the side opposite the stack 2. The receiver bottle 5 is of a generally cylindrical shape, extending longitudinally in parallel with the base plate 4. A removable cap 28 is provided at an open end of the receiver bottle to provide an enclosed internal volume 47 therein. During operation of the system, refrigerant that is condensed within the heat exchanger 1 is received and stored within the internal volume 47, with the refrigerant contained therein being generally in a saturated state. Liquid phase refrigerant is extracted from the receiver bottle 5 and is subcooled within the heat exchanger 1 before being delivered to an expansion valve of the refrigerant circuit. Although not shown, a desiccant material can optionally be provided within the internal volume 47 to remove moisture from the refrigerant.

A second refrigerant fitting 6 is also joined to the base plate 4 on the side opposite the stack 2. This second refrigerant fitting 6 provides an outlet port 8 for the refrigerant, whereas the previously mentioned first refrigerant fitting 6 (joined to the cap plate 13) provides an inlet port 7 for the refrigerant (best seen in FIGS. 3A and 3B). When installed into a refrigerant system, refrigerant lines 11 equipped with clamps 9 are sealingly joined to the fittings 6 using securing screws 10 in order to join the liquid to refrigerant heat exchanger into a refrigerant circuit in a sealed and generally leak-free fashion.

Figure 2:
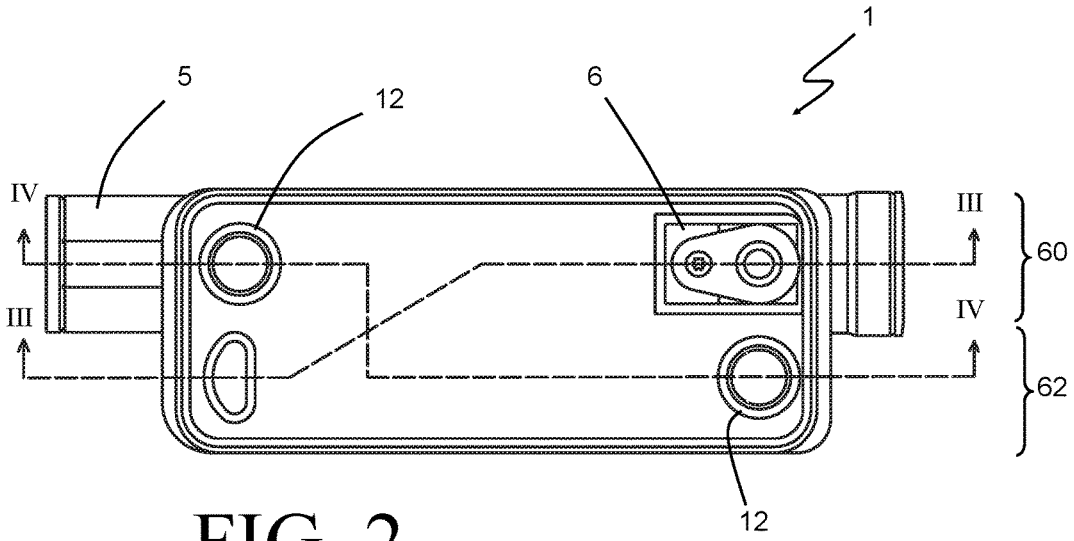
FIG. 2 is a top view of the liquid to refrigerant heat exchanger of FIG. 1.

The nested plates 3 are of a generally rectangular design, and the receiver bottle 5 is oriented so that the axial direction of the bottle 5 extends in parallel to the long edges of the rectangular plates 3. The central axis of the bottle 5 is arranged on a first lateral side 60 of the stack to be directly below the refrigerant inlet port 7 and one of the liquid ports 12, that one of the liquid ports 12 being located along a common long edge of the plates 3 with the refrigerant inlet port 7, as shown in FIG. 2. Space is thus provided for the refrigerant fitting 6 containing the refrigerant outlet port 8 to be arranged on a second lateral side 62 of the stack alongside the receiver bottle 5 at a location corresponding to that corner of the stack 2 which is diagonally opposed to the corner where the refrigerant inlet port 7 is located, as shown in FIGS. 2 and 5.

Figure 5:
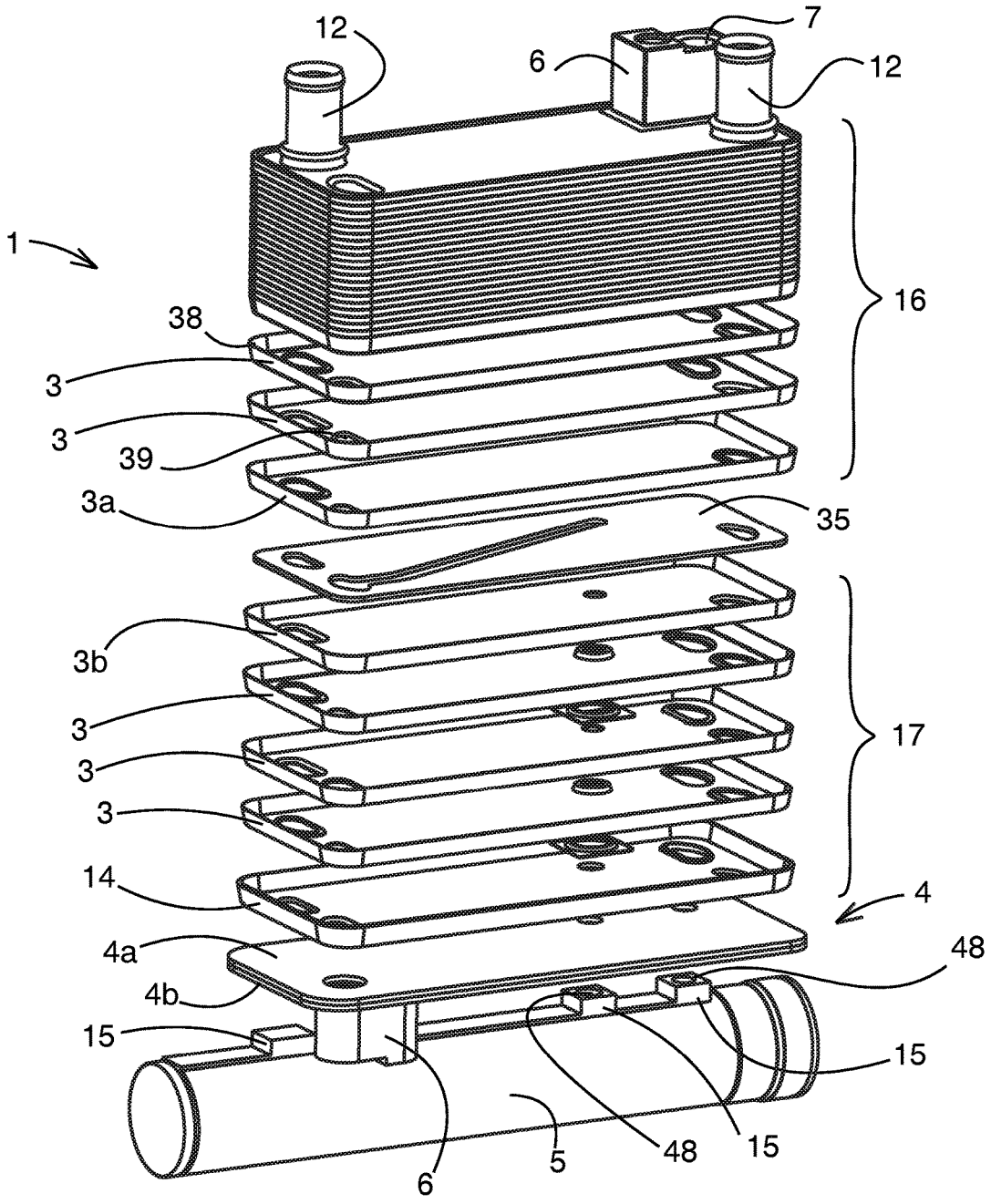
FIG. 5 is a partially exploded perspective view of the liquid to refrigerant heat exchanger of FIG. 1.
Figure 6:
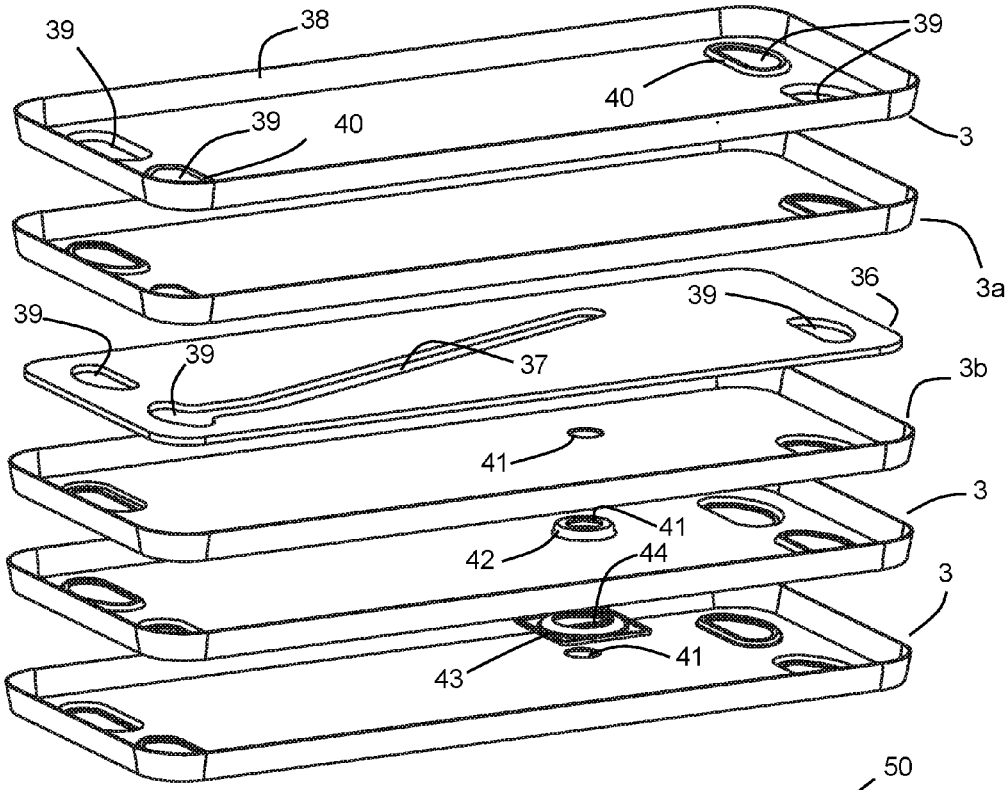
FIG. 6 is a partial view showing selected components of the exploded view of FIG. 5.

Turning now to FIGS. 5 and 6, features of the nested plates 3 and the plate stack 2 will be described in further detail.

Each of the nested plates 3 is bounded by a continuous upturned edge rim 38 arranged at a slightly obtuse angle to the flat base of the plate. These edge rims 38 allow adjacent plates to nest together in order to create a sealed perimeter along the outer surfaces of the stack 2, with the flat portions of the plates 3 spaced apart to define fluid flow passages therebetween. Refrigerant and liquid coolant passages are interlaced in alternating fashion, as will be described.

With certain exceptions that will be described in detail later, the nested plates 3 are all provided with apertures 39 arranged at each of the four corners of the plate. The corner apertures 39 are circumscribed by a formed edge 40 extending away from the flat surface of the plate, with two diagonally opposing apertures 39 having the formed edge 40 extending up in the same direction as the upturned edge rim 38, and the remaining two diagonally opposing apertures 39 of each plate 3 having the formed edge 40 extending in the opposite direction. The heights of the formed edges 40 are such that a formed edge 40 of a first one of the plates 3 will engage with a formed edge 40 of a second adjacent one of the plates 3 at two of the corners, thereby providing sealed joints within the flow passage between the two plates at those two corners. The apertures 39 at the remaining two corners are left open to the flow passage. The sealed joints are located at the alternate corners in the adjacent flow passages.

As shown in FIGS. 5 and 6, two adjacent nested plates 3*a* and 3*b* are provided at a particular location within the stack 2 and serve to divide the stack 2 into a first portion 16 and a second portion 17. The first portion 16 extends from the top terminal plate 14 to the plate 3*a*, while the second portion 17 extends from the bottom terminal plate 14 to the plate 3*b*. In the exemplary embodiment, the first portion 16 operates as a condenser, and the second portion 17 operates as a subcooler.

As best seen in FIG. 6, certain ones of the corner apertures 39 are absent in the plates 3*a* and 3*b*. Specifically, there is no corner aperture 39 in the plate 3*a* at the corner that corresponds to the location of the refrigerant inlet port 7, and there are no corner apertures 39 in the plate 3*b* at the corners corresponding to the locations of both the refrigerant inlet port 7 and the refrigerant outlet port 8. In addition, the corner aperture 39 of the plate 3*a* in the corner that corresponds to the location of the refrigerant outlet port 8 is provided without the corresponding formed edge 40.

A fluid transfer plate 36 is provided in the space between the nested plates 3*a* and 3*b*. Matching corner apertures 39 are provided in the fluid transfer plate 36 at at least the corners that correspond to the locations of the liquid ports 12 and the refrigerant outlet port 8. A fluid transfer conduit 37 extends from the aperture 39 at the refrigerant outlet port 8 corner to a central location within the fluid transfer plate 36.

Figure 4:
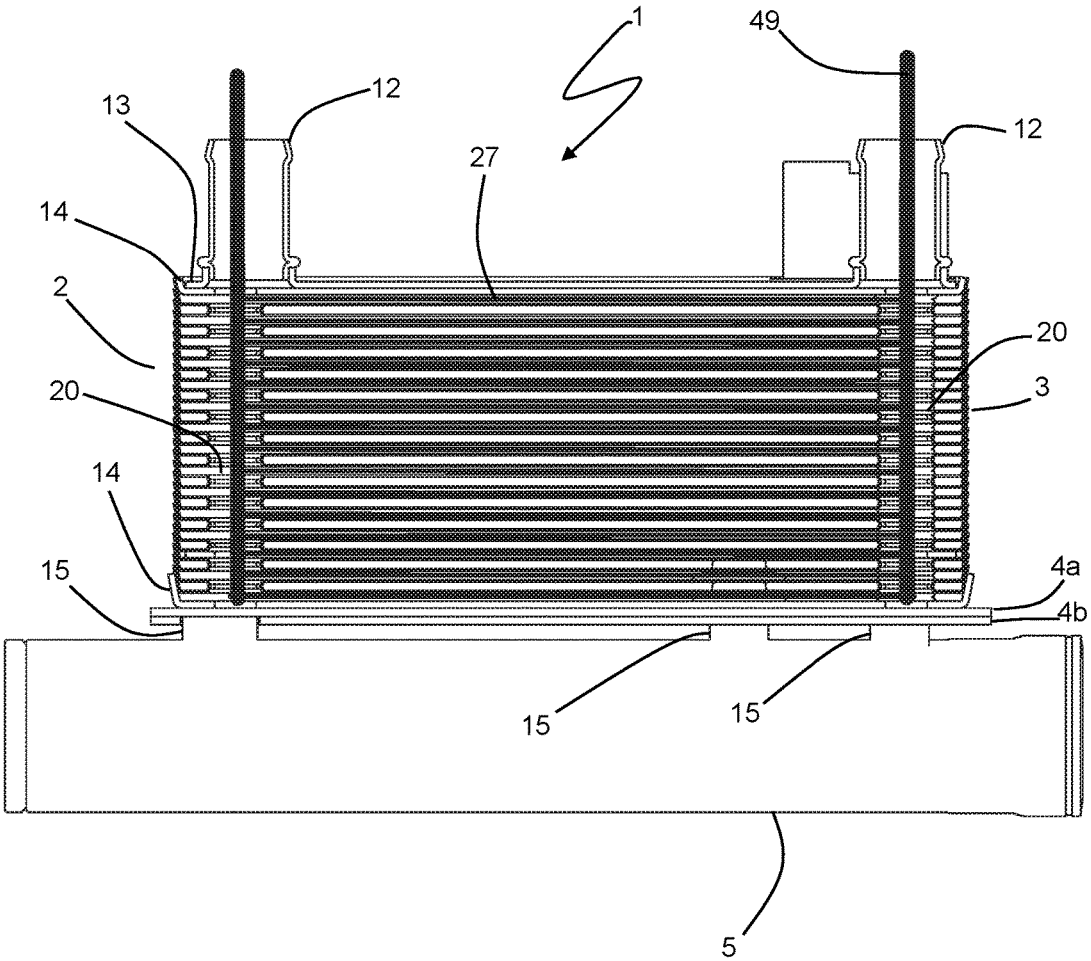
FIG. 4 is a sectional side view of the liquid to refrigerant heat exchanger of FIG. 1, taken along the line IV-IV of FIG. 2.

The aligned corner apertures 39 cooperate to define fluid manifolds at each of the corners of the stack 2. In the exemplary embodiment of the liquid to refrigerant heat exchanger, a total of six such corner manifolds are present. First and second manifolds 20 extend in opposing corners of the stack 2 the entire height between the terminal plates 14, as best seen in FIG. 4. Each of the manifolds 20 is arranged in a corner directly below one of the liquid ports 12, and is in fluid communication therewith. One of the liquid manifolds 20 functions as an inlet manifold to receive a flow of liquid coolant 49 into the liquid to refrigerant heat exchanger 1 through one of the ports 12, and delivers that flow to liquid flow passages 27 arranged between some of the nested plates 3. The other of the liquid manifolds 20 functions as an outlet manifold to collect the flow of liquid coolant from the flow passages 27, and directs the liquid coolant out of the heat exchanger 1 through the other port 12.

Figure 3A:
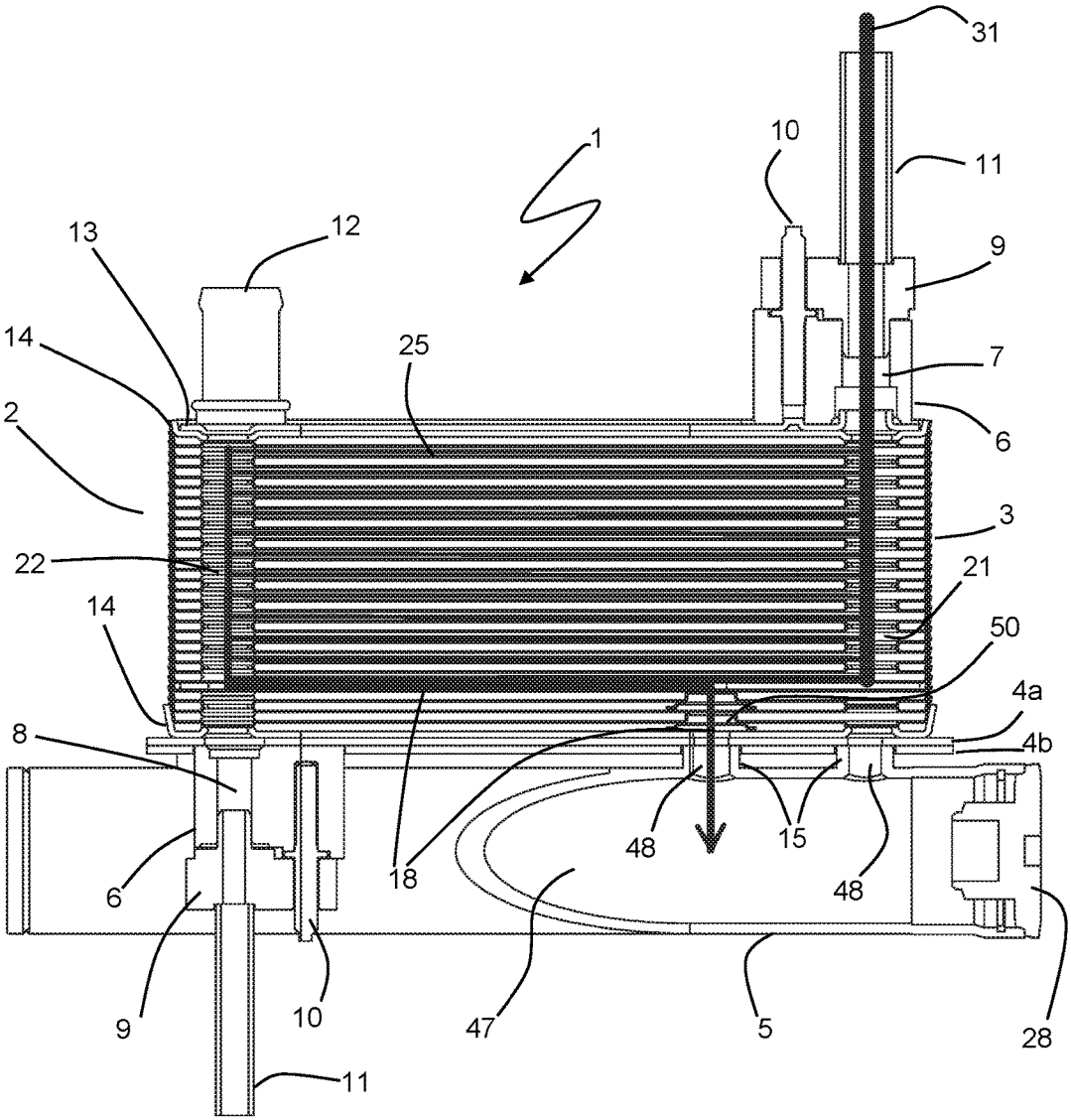
FIGS. 3A-3B are sectional side views of the liquid to refrigerant heat exchanger of FIG. 1, taken along the line of FIG. 2.
Figure 3B:
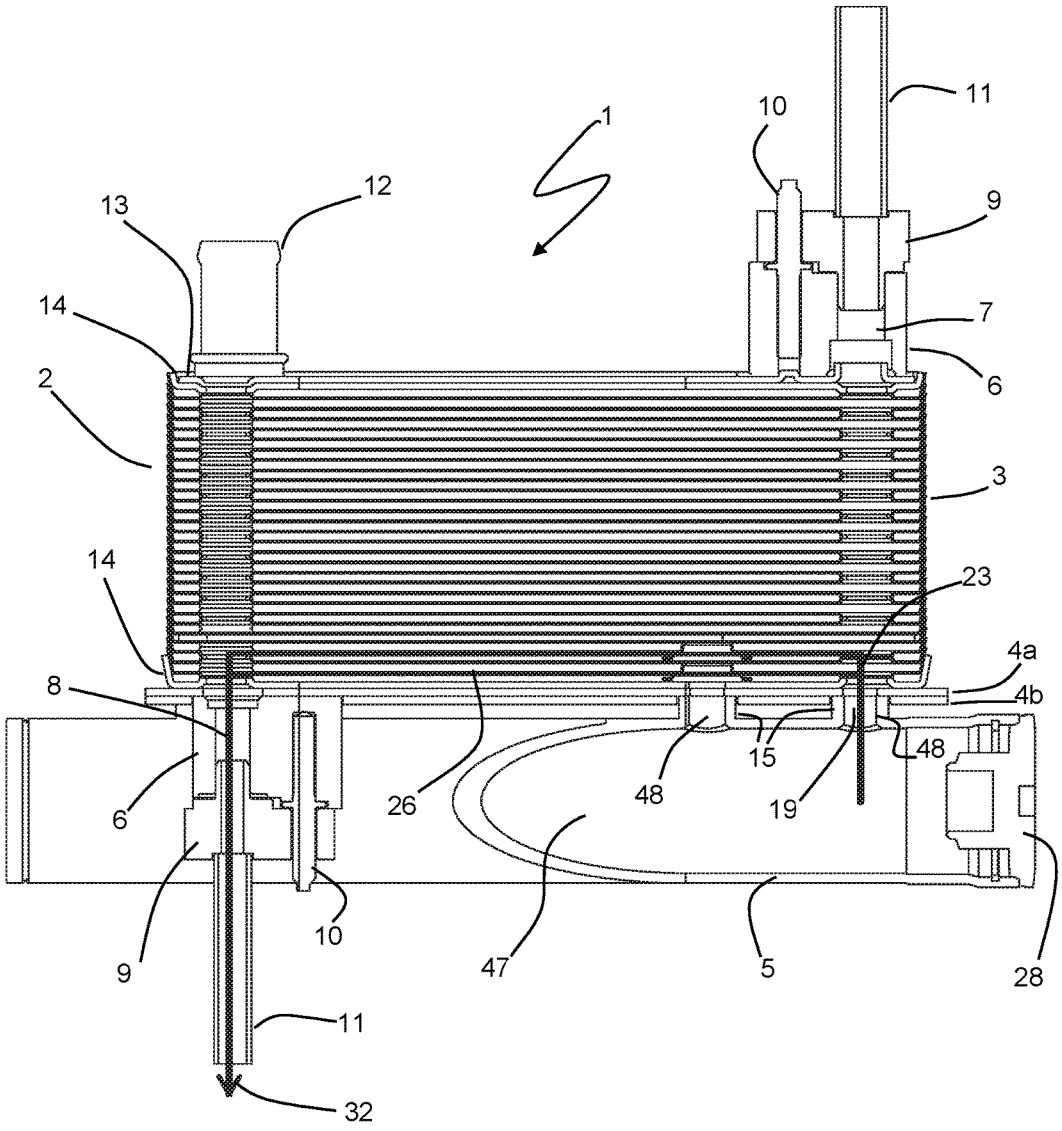

A third manifold 21 extends through the section 16 of the stack 2 in the corner corresponding to the location of the refrigerant inlet fitting 6. As best seen in FIG. 3A, the manifold 21 is in direct fluid communication with the refrigerant inlet port 6, and functions as a refrigerant inlet manifold to receive a flow of refrigerant 31 through the refrigerant inlet port 6 and to distribute that flow of refrigerant to refrigerant flow passages 25 arranged between some of the nested plates 3 in the section 16 of the stack 2. The refrigerant flow passages 25 are interleaved with those ones of the liquid flow passages 27 located within the section 16, so that efficient heat transfer between the refrigerant and the liquid coolant flowing in those passages can be achieved.

A fourth manifold 22 extends through the section 16 in the corner diagonally opposing the manifold 21, and is in fluid communication with the flow passages 25 to receive the refrigerant flow 31 therefrom. The fourth manifold is additionally in fluid communication with the fluid transfer conduit 37 provided in the fluid transfer plate 36.

A fifth manifold 23 extends through the section 17 of the stack 2 and is aligned with the manifold 21, and a sixth manifold 24 extends through the section 17 and is aligned with the manifold 22. The lack of corner apertures in the nested plates 3*a* and 3*b*, as well as in the fluid transfer plate 36, in the corner corresponding to the manifolds 23, 21 provides for fluid isolation of those manifolds from one another. It should be appreciated, however, that such isolation can be similarly achieved by the absence of the corner aperture in any one of those three plates. In a similar fashion, the lack of a corner aperture in the plate 3*b* in the corner corresponding to the manifolds 22, 24 provides for fluid isolation of those manifolds from one another.

The manifolds 23, 24 are connected by flow passages 26 arranged between some of the nested plates 3 in the section 17, those flow passages 26 being interleaved with those ones of the liquid flow passages 27 located within the section 17. A flow of refrigerant 32 can be received into the manifold 23 from the receiver bottle 5 through a receiver flow path 19, so that the refrigerant 32 is placed into heat exchange relationship with the liquid coolant passing through those flow passages 25 as it passes through the refrigerant flow passages 26. The manifold 24 is in fluid communication with the refrigerant outlet port 8, so that the flow of refrigerant 32 can be removed from the heat exchanger 1 after having passed through the section 17.

Figure 10:
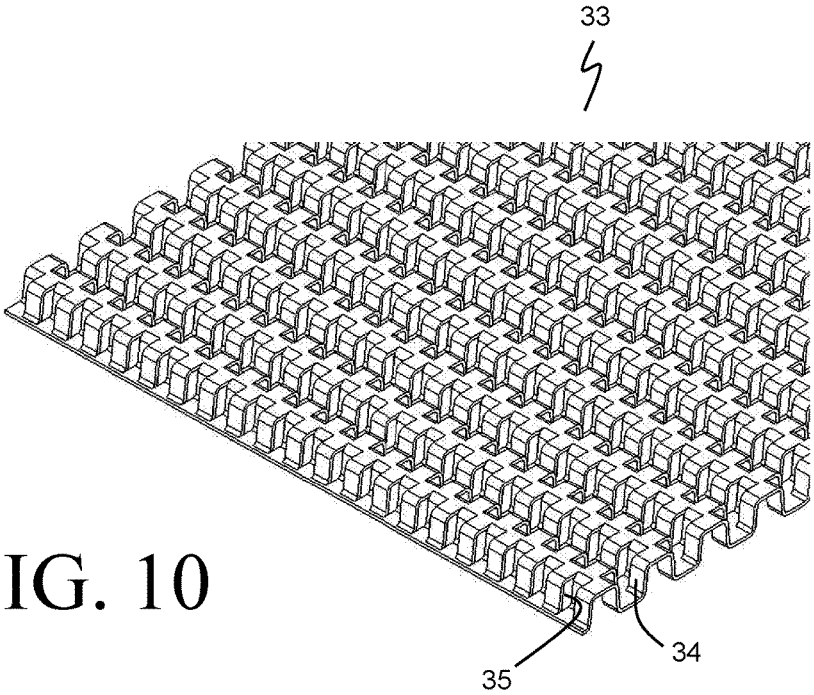
FIG. 10 is a partial perspective view of a lanced and offset fin sheet for use in some embodiments of the invention.

Fluid permeable flow sheets, while not shown in FIGS. 1-6, can be included between nested plates 3 to provide for increased heat transfer to and from the fluids in the flow passages 25, 26, and 27. One preferable example of such a flow sheet is a lanced and offset fin sheet 33, shown in FIG. 10. The lanced and offset fin sheet 33 is formed from a thin metal sheet that is pierced and formed to create convolutions 34 of a height that corresponds to the spacing between the nested plates 3. Apertures 35 are formed into the walls of the corrugations 34 to both provide increased turbulation of the flow and to allow for fluid flow in a direction perpendicular to the corrugations. Apertures (not shown) can be formed into the sheet 33 at locations corresponding to the corner apertures 39 to avoid interference with the engaged formed edges 40, and to allow for unobstructed fluid flow through the corner manifolds.

Figure 7:
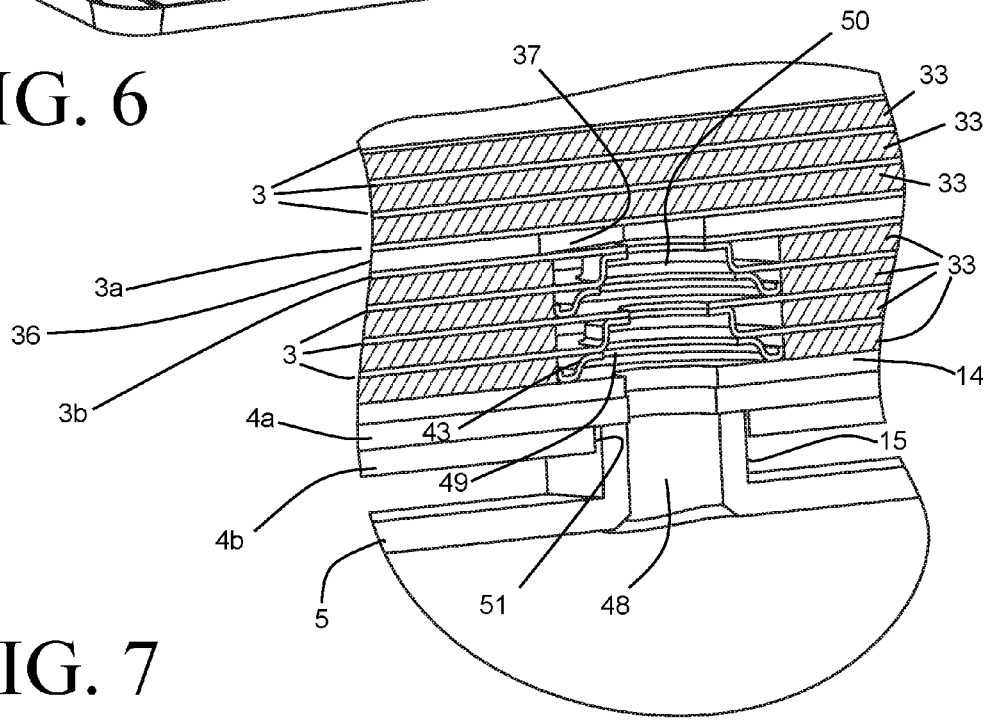
FIG. 7 is a partial section view of the liquid to refrigerant heat exchanger of FIG. 1.

An additional refrigerant manifold 50 extends through the section 17 at a location that is not in a corner of the stack 2, but is instead located more centrally within the plates 3 of that portion of the heat exchanger 1. The manifold 50 is arranged along an imaginary straight line between the manifold 21 and the opposing manifold 20. Apertures 41 in those ones of the nested plates 3 in the section 17 of the stack 2 together at least partially define the manifold 50. Fluid isolation of the manifold 50 from the flow passages 26 and 27 can be achieved by a formed boss 42 surrounding the aperture 41 on some of the nested plates 3, and by formed inserts 43 arranged between the plates 3 on adjacent layers, as shown in FIGS. 6 and 7. The fin sheets 33 in the section 17 can be relieved at the location corresponding to the manifold 50, as shown in FIG. 7.

In some highly preferable embodiments, many of the components of the liquid to refrigerant heat exchanger are constructed of a brazeable aluminum alloy, and are joined together in a furnace brazing operation. It can be particularly economical for the stack 2 of nested plates 3, the cap plate 13, the base plate 4, the fittings 6, the ports 12, and the receiver bottle 5 to be so joined in a single brazing operation.

The internal volume 47 of the receiver bottle 5 is in fluid communication with both the manifold 50 and the manifold 23 by way of flow apertures 48 that extend through at least some of the structural support 15 joining the receiver bottle 5 to the base plate 4. As best seen in the partially exploded view of FIG. 5, the receiver bottle 5 includes three integral structural supports 15 that extend from the outer surface of the bottle 5 to a common planar surface. In the exemplary embodiment the base plate 4 is constructed of a first plate, 4*a*, joined to a second plate, 4*b*. Such an arrangement can be especially preferable in that pockets 51 can be provided in the plate 4*b* to locate and receive the structural supports 15, thereby ensuring that the receiver bottle 5 is properly located with respect to the base plate 4. Similar results can be achieved with a single piece base plate 4 wherein the pockets extend only partway through the thickness of the base plate, but such an arrangement would most likely incur additional fabrication costs.

The previously described fluid transfer conduit 37 in the fluid transfer plate 36 extends between the manifold 22 and the manifold 50, and establishes a first receiver flow path 18 (shown in FIG. 3A) to deliver refrigerant that has passed through the flow passages 25 to the internal volume 47 of the receiver bottle 5. The first receiver flow path thus includes the fluid transfer conduit 37, the manifold 50, and one of the apertures 48. A second receiver flow path 19 (shown in FIG. 3B) includes the other aperture 48 and the manifold 23. A flow of refrigerant 32 is extracted from the internal volume 47 of the receiver bottle 5 by way of the flow path 19, and is directed along the flow passages 26 before being collected in the manifold 24 and removed from the heat exchanger 1 by way of the refrigerant outlet port 8.

In a highly preferable embodiment, the first section 16 of the liquid to refrigerant heat exchanger 1 functions as a condenser section to cool and substantially condense the refrigerant 31. The refrigerant 31 is collected in the manifold 22 and is directed by way of the receiver flow path 18 into the internal volume 47 of the receiver bottle. In certain operating conditions the refrigerant 31 may be condensed entirely, so that the refrigerant 31 enters the volume 47 in a saturated or slightly subcooled liquid state. In other operating conditions the refrigerant 31 may be mostly condensed to a liquid state but may still have some vapor quality remaining, so that it enters the volume 47 in a two-phase (liquid and vapor) state.

By transferring the refrigerant from the condenser section 16 into the receiver bottle 5 by way of the internally located flow path 18, any need for routing the refrigerant external to the stack 2 is avoided. This can beneficially avoid excess costs associated with such fluid routing, as well as the complexity that is associated with the manufacturing of a heat exchanger employing such external routing.

The primary function of the receiver bottle 5 within the system is to provide a charge storage capacity within the internal volume 47. The internal volume 47 will generally contain refrigerant in both a liquid state and in a vapor state, in varying proportion which is primarily determined by the amount of charge contained within the refrigerant system and the instant operating conditions. The inclusion of the receiver 5 avoids the undesirable accumulation of excess charge within the condenser section itself, thereby improving the operating performance of the heat exchanger 1.

Performance efficiency of the refrigerant system is further optimized by subcooling the liquid refrigerant to a lower enthalpy state prior to delivering the refrigerant to an expansion device of the system. In a highly preferable embodiment, the section 17 of the liquid to refrigerant heat exchanger 1 is a subcooler section, and the flow of refrigerant 32 is a liquid flow of refrigerant that is received from the volume 47 and is subcooled as it passes through the flow channels 26 by transferring heat to the flow of liquid coolant passing through the subcooler section 17. Proper separation of the refrigerant within the volume 47 into a liquid portion and a vapor portion (using, for example, gravity effects) can ensure that the flow of refrigerant introduced into the flow passages 26 through the flow path 19 is in a fully liquid state.

Turning now to the design of the manifold 50 as best seen in FIG. 7, it can be seen that on every other one of the plates 3 within the section 17 the boss 42 is formed away from the flat surface of the plate 3 to a height that is approximately equal to the space between adjacent ones of the nested plates 3. A flat landing surrounding the hole 41 in these plates thus directly abuts the planar surface of the adjacent plate, so that a seal between the plates can be created at that location by, for example, brazing. The inserts 43 are placed between the plates on adjacent layers to provide structural support and sealing of the manifold 50 from the flow paths on those layers. The inserts 43 are formed from flat sheet metal to a shape having a height approximately equal to the space between adjacent plates, and are provided with a flat landing surface at both ends of the height in order to seal against both of the plates 3 that define the flow layer within which the insert 43 is placed. An aperture 44 is provided in each of the inserts 43, and is in direct alignment with the aperture 41 of the adjacent plate. Joints between the insert 43 and the flat surfaces of the plates can be made at the same time as the joints between the bosses 42 and their adjacent plates by, for example, brazing.

The alternating arrangement of bosses 42 and inserts 43 can beneficially provide a structurally robust and leak-free column surround the manifold 50 so that the flow of refrigerant can be efficiently transported from the condenser section of the liquid to refrigerant heat exchanger 1 to the receiver without requiring routing of the fluid external to the heat exchanger 1. In certain application, other embodiments of heat exchanger 1 with varying manifold designs may be preferable and have been contemplated by the inventors. In one such design, the inserts 43 are formed from a flat piece of material having a thickness approximately equal to the desired spacing between the plates 3, so that forming of the insert is no longer necessary. Such a design provides additional structural robustness and rigidity, but at a slightly greater weight penalty and, possibly, greater cost.

Figure 8:
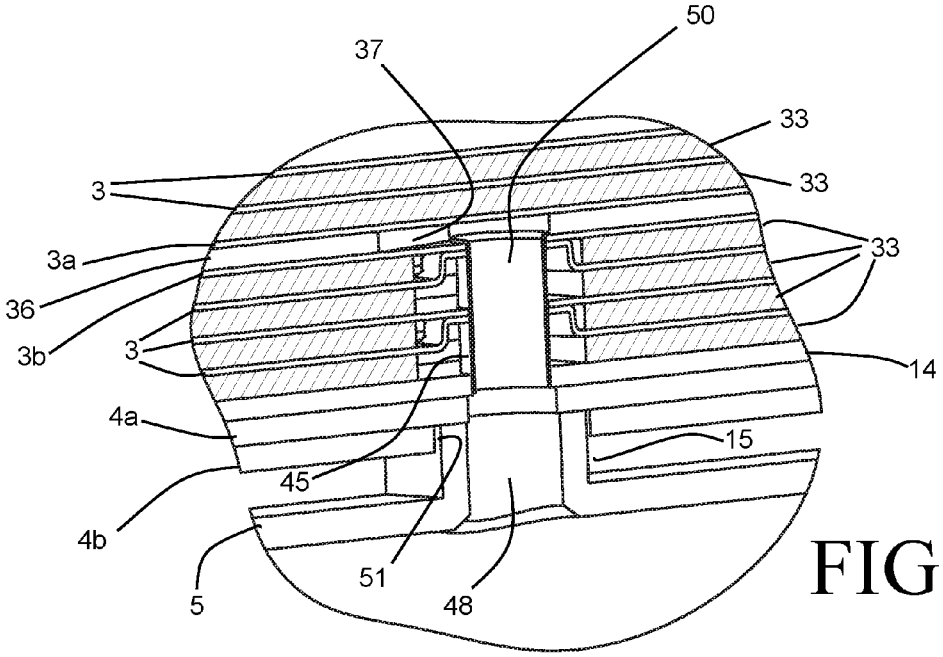
FIG. 8 is a partial section view of an alternative embodiment of the liquid to refrigerant heat exchanger of FIG. 1.
Figure 9:
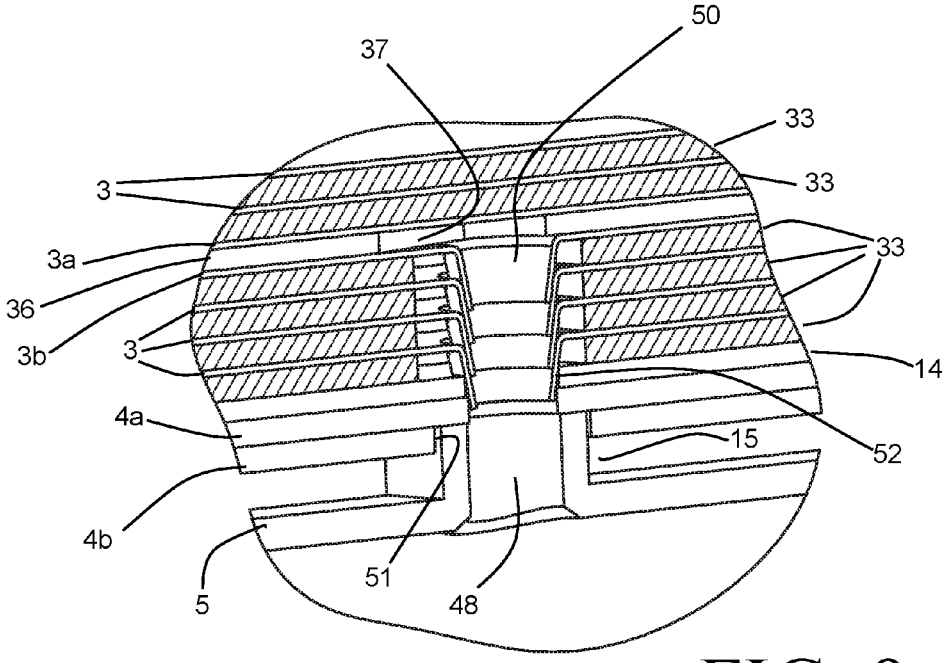
FIG. 9 is a partial section view of another alternative embodiment of the liquid to refrigerant heat exchanger of FIG. 1.

An additional alternative design is depicted in FIG. 8, and includes a sleeve insert 45 that extends from the fluid transfer plate 36 to the base plate 4. This alternative design allows for the elimination of the inserts 43, and can accommodate a smaller relief of the fin sheets 33 around the manifold 5. Yet another alternative design is depicted in FIG. 9. In this design, the inserts 43 and bosses 42 have been removed entirely. In their place, a tapered frustoconical protrusion 52 is provided in each plate 3 at the location of the manifold 50, with the apertures 41 provided at the apex of the protrusions 52. The angle of the protrusion 52 is such that the protrusions 52 of adjacent plates 3 nest together in similar fashion as the edge rims 38 of the plates, thereby providing the requisite fluid seal to isolate the manifold 50 from the flow paths 26 and 27 in the section 17.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A liquid to refrigerant heat exchanger, comprising:

a stack of nested plates with fluid flow passages between the plates, the stack of nested plates extending in a stacking direction between a top end and a bottom end of the stack of nested plates, the stack having first, second, third, and fourth corners that extend in the stacking direction between the top end and the bottom end of the stack, a first subset of the stack of plates adjacent to the top end defining a condenser portion, a second subset of the stack of plates adjacent to the bottom end defining a subcooler portion;

a cap plate arranged at the top end of the stack of nested plates and joined thereto;

a refrigerant inlet port joined to the cap plate at the first corner;

a base plate arranged at the bottom end of the stack of nested plates and joined thereto;

a refrigerant outlet port joined to the base plate at the second corner;

a receiver bottle joined to the base plate at the first corner;

a first structural connection joining the receiver bottle to the base plate, a first receiver flow path extending through the first structural connection to allow for fluid flow between an internal volume of the receiver bottle and the condenser portion;

a second structural connection joining the receiver bottle to the base plate, a second receiver flow path extending through the second structural connection to allow for fluid flow between an internal volume of the receiver bottle and the subcooler portion; and a fluid transfer plate arranged within a first one of the fluid flow passages, the fluid transfer plate including a fluid transfer conduit, wherein the receiver bottle extends between the first corner and the third corner in an axial direction of the receiver bottle and in parallel to a longitudinal direction of the stack, wherein the fluid transfer conduit at least partially fluidly connects a second one of the fluid flow passages in the condenser portion to the receiver bottle, and wherein the fluid transfer conduit at least partially extends in a non-parallel direction relative to the longitudinal direction.

2. The liquid to refrigerant heat exchanger of claim 1, further comprising a refrigerant manifold extending through the subcooler portion and hydraulically isolated therefrom, wherein the refrigerant manifold provides a portion of the first receiver flow path, wherein the refrigerant manifold is at least partially defined by a first insert within a third one of the fluid flow passages and a first boss within a fourth one of the fluid flow passages, and wherein the third one of the fluid flow passages is adjacent to the fourth one of the fluid flow passages.

3. The liquid to refrigerant heat exchanger of claim 1, further comprising:

a first refrigerant manifold arranged at a first corner of the stack of nested plates and extending through only the condenser portion and fluidly coupled to the refrigerant inlet port to receive the flow of refrigerant therefrom;

a second refrigerant manifold arranged at a second corner of the stack of nested plates and extending through only the condenser portion and connected to the first refrigerant manifold by some of the fluid flow passages defined between the plates of the condenser portion; and a third refrigerant manifold extending through the subcooler portion and hydraulically isolated therefrom and providing a portion of the first receiver flow path.

4. The liquid to refrigerant heat exchanger of claim 3, further comprising:

a first liquid manifold arranged at a third corner of the stack of nested plates; and a second liquid manifold arranged at a fourth corner of the stack of nested plates, the first and second liquid manifolds being connected by some of the fluid flow passages defined between plates in both the condenser portion and the subcooler portion, the third refrigerant manifold being offset from the first, second, third, and fourth corners.

5. The liquid to refrigerant heat exchanger of claim 3, wherein the first one of the fluid flow passages is provided in a space between a first one of the nested plates and a second, adjacent one of the nested plates, said first one of the nested plates defining an end of the condenser portion and said second one of the nested plates defining an end of the subcooler portion, and wherein the fluid transfer conduit within the fluid transfer plate extends between the second and third refrigerant manifolds to provide a portion of the first receiver flow path.

6. The liquid to refrigerant heat exchanger of claim 5, further comprising:

a fourth refrigerant manifold arranged at the first corner of the stack of nested plates and extending through only the subcooler portion and fluidly coupled to the second receiver flow path to receive the flow of refrigerant therefrom;

a fifth refrigerant manifold arranged at the second corner of the stack of nested plates and extending through only the subcooler portion and fluidly coupled to the refrigerant outlet port to deliver the flow of refrigerant thereto, the fourth and fifth refrigerant manifolds being connected by some of the fluid flow passages defined between plates in the subcooler portion.

7. The liquid to refrigerant heat exchanger of claim 6, wherein the second and the fifth refrigerant manifolds are fluidly isolated from each other by said second one of the nested plates.

8. The liquid to refrigerant heat exchanger of claim 3, further comprising a plurality of inserts, each of the plurality of inserts being arranged between at least some of the nested plates in the subcooler portion to at least partially define the third refrigerant manifold, wherein each of the plurality of inserts is surrounded by one of the fluid flow passages, wherein each of the plurality of inserts surrounds an opening in at least one of the at least some of the nested plates, and wherein each of the plurality of inserts is joined to the at least some of the nested plates.

9. The liquid to refrigerant heat exchanger of claim 1, wherein the base plate includes a first base plate and a second base plate, the second base plate including pockets, and wherein the first structural connection and the second structural connection are each located within one of the pockets.

10. The liquid to refrigerant heat exchanger of claim 9, wherein the receiver bottle includes a third structural connection, wherein the third structural connection is located within one of the pockets, and wherein the third structural connection is located at the third corner.

11. The liquid to refrigerant heat exchanger of claim 1, further comprising:

a first refrigerant manifold arranged at a first corner of the stack of nested plates, wherein the first refrigerant manifold extends though only the condenser portion and is fluidly coupled to the refrigerant inlet port to receive the flow of refrigerant therefrom; and a second refrigerant manifold arranged at a second corner of the stack of nested plates diagonally opposite the first corner, wherein the second refrigerant manifold extends through only the subcooler portion and is fluidly coupled to the refrigerant outlet port to deliver the cooler and condensed refrigerant thereto.

12. The liquid to refrigerant heat exchanger of claim 11, wherein the refrigerant inlet port is aligned with the first refrigerant manifold and the refrigerant outlet port is aligned with the second refrigerant manifold.

13. The liquid to refrigerant heat exchanger of claim 11, further comprising a first liquid manifold arranged at a third corner of the stack of nested plates and a second liquid manifold arranged at a fourth corner of the stack of nested plates diagonally opposite the third corner, wherein the receiver bottle extends directly underneath the first corner and one of the third and fourth corners.

14. A liquid to refrigerant heat exchanger, comprising:

a stack of nested plates with fluid flow passages between the plates, the stack of nested plates extending in a stacking direction between a top end and a bottom end of the stack of nested plates;

a first refrigerant manifold extending parallel to the stacking direction from the top end to a first one of the nested plates on a first lateral side of the stack;

a second refrigerant manifold extending parallel to the stacking direction from the top end to the first one of the nested plates on a second lateral side of the stack;

a third refrigerant manifold extending parallel to the stacking direction from a second one of the nested plates to the bottom end on the first lateral side of the stack;

a fourth refrigerant manifold extending parallel to the stacking direction from the second one of the nested plates to the bottom end on the first lateral side of the stack;

a fifth refrigerant manifold extending parallel to the stacking direction from the second one of the nested plates to the bottom end on the second lateral side of the stack;

a first liquid manifold extending parallel to the stacking direction on the first lateral side of the stack;

a second liquid manifold extending parallel to the stacking direction on the second lateral side of the stack;

a refrigerant inlet port fluidly connected to the first refrigerant manifold on the first lateral side of the stack;

a refrigerant outlet port fluidly connected to the fifth refrigerant manifold on the second lateral side of the stack;

a receiver bottle including a first structural connection extending parallel to the stacking direction and at least partially defining a flow path with the third refrigerant manifold, a second structural connection extending parallel to the stacking direction and at least partially defining another flow path with the fourth manifold, and a central axis located on the first lateral side; and a fluid transfer plate arranged between the first one and the second one of the nested plates, the fluid transfer plate including a fluid transfer conduit that extends at least partially from the second lateral side of the stack to the first lateral side of the stack between the second manifold and the third manifold, wherein the fluid transfer conduit fluidly connects the second manifold to the third manifold, wherein the first refrigerant manifold is fluidly connected to the second refrigerant manifold by at least one of the fluid flow passages located between the top end and the first one of the nested plates, wherein the fourth refrigerant manifold is fluidly connected to the fifth refrigerant manifold by at least one of the fluid flow passages located between the bottom end and the second one of the nested plates, and wherein the first liquid manifold is fluidly connected to the second liquid manifold by at least one of the fluid flow passages located between the top end and the first one of the nested plates and by at least one of the fluid flow passages located between the bottom end and the second one of the nested plates.

15. The liquid to refrigerant heat exchanger of claim 14, wherein the fluid transfer plate includes apertures that partially define the second refrigerant manifold, the first liquid manifold, and the second liquid manifold.

16. The liquid to refrigerant heat exchanger of claim 14, wherein a first one of the fluid flow passages between the bottom end and the second one of the nested plates includes an insert that partially defines the third manifold.

17. The liquid to refrigerant heat exchanger of claim 16, wherein a second one of the fluid flow passages between the bottom end and the second one of the nested plates includes a formed boss that partially defines the third manifold.

18. The liquid to refrigerant heat exchanger of claim 16, wherein the insert includes flat landing surfaces that are joined to two adjacent plates of the nested plates.

19. The liquid to refrigerant heat exchanger of claim 18, wherein the insert includes an insert aperture that is in direct alignment with an aperture in one of the nested plates and is in direct alignment with an opening in the first structural connection.

20. The liquid to refrigerant heat exchanger of claim 17, wherein the first one of the fluid flow passages is adjacent to the second one of the fluid flow passages.

* * * * *